US005624032A

United States Patent [19]

Yucknut et al.

[11] Patent Number: 5,624,032

[45] Date of Patent: Apr. 29, 1997

[54] PACKAGING SYSTEM WITH PRODUCT COLLAR SUPPORT

[75] Inventors: Stephen M. Yucknut, Danbury, Conn.; Nicholas H. Winters, Suffern, N.Y.

[73] Assignee: Kraft Foods, Inc., Northfield, Ill.

[21] Appl. No.: 519,908

[22] Filed: Aug. 28, 1995

[51] Int. Cl.[6] ..... B65D 75/00

[52] U.S. Cl. ..... 206/433; 206/589; 229/120.32; 229/120.38

[58] Field of Search ..... 206/521, 588, 206/589, 427, 433, 139, 160, 174, 179, 193, 194, 196, 197, 199; 229/120.32, 120.38

[56] References Cited

U.S. PATENT DOCUMENTS

| | | | |
|---|---|---|---|
| 492,305 | 2/1893 | Meech | 206/427 |
| 1,826,104 | 10/1931 | van Cleaf | 206/589 X |
| 1,923,089 | 8/1933 | Helt | 206/427 |
| 1,963,677 | 6/1934 | Roberts | 206/427 |
| 2,665,026 | 1/1954 | Katzman | 206/427 X |
| 2,807,402 | 9/1957 | Nelbach | 62/80 |
| 3,279,677 | 10/1966 | Wojcik | 206/521 |
| 3,301,460 | 1/1967 | Harrison | 206/589 X |
| 3,734,280 | 5/1973 | Amneus et al. | 206/65 R |
| 3,804,234 | 4/1974 | Gordon | 206/65 Y |
| 4,062,448 | 12/1977 | Meighan | 206/432 |
| 4,223,827 | 9/1980 | Gilbert | 206/433 X |
| 5,071,026 | 12/1991 | Apps | 206/427 X |
| 5,439,110 | 8/1995 | Regan, II | 206/427 |
| 5,518,111 | 5/1996 | Stout | 206/160 |

*Primary Examiner*—Jacob K. Ackun

*Attorney, Agent, or Firm*—Thomas R. Savoie; Thomas A. Marcoux

[57] ABSTRACT

A packaging system for protecting the uppermost ends of a plurality of elongated, upright products includes a case having a floor on which the products stand in a preset pattern and side walls extending upwardly from the floor. A collar maintains the products in the preset pattern and includes a base provided with a preset pattern of holes matching the preset pattern of the products such that the uppermost ends are received through the holes and such that the base positively rests on the upper portions of the products at a predetermined height. The collar also includes upstanding sides projecting from a periphery of the base, the sides having a height from the base which is greater than a distance of the uppermost ends of the products from the base. A top is further provided for the case which is supported by the side walls. A support element resting on the base is located between the products for maintaining the top of the case separated from the uppermost ends as the support element has a height from the base which is greater than a distance of the uppermost ends of the products from the base. Conveniently, the support element is formed of a single strip formed into a squared tooth shape.

3 Claims, 2 Drawing Sheets

PACKAGING SYSTEM WITH PRODUCT COLLAR SUPPORT

FIELD OF THE INVENTION

The present invention relates generally to a packaging system for elongated, upright products, and more particularly to a packaging system for a plurality of elongated, upright products having a fragile uppermost end and a downwardly diverging upper portion which uppermost end is protected from engagement with the top of a surrounding package by means of a collar engaging the upper portions and a support member located between the collar and the top of the packaging system.

BACKGROUND OF THE INVENTION

In the production and shipping of elongated products such as blow-molded, plastic bottles, as disclosed in U.S. Pat. No. 5,188,250 problems have arisen due to leakage of the liquids contained in these soft plastic bottles. This leakage problem is primarily due to the fragile uppermost end of these bottles, which uppermost ends are designed to be easily twisted away to provide an orifice for drinking the liquid from the bottle. During shipping of these bottles in corrugated cases or the like, any impact engagement of the uppermost end(s) of a bottle(s) with the top of the shipping case may damage such end(s) and cause the bottle(s) to leak.

SUMMARY OF THE INVENTION

In accordance with the present invention, a packaging system is provided for a plurality of elongated upright products where each product has an uppermost end and a downwardly diverging upper portion beneath the uppermost end. The packaging system is designed to protect the uppermost ends of the products. The packaging system includes a case having a floor on which the products stand in a preset pattern, and side walls extending upwardly from the floor. A collar in the case maintains the products in the preset pattern within the case. This collar includes a base provided with a preset pattern of holes matching the preset pattern of the products, such that the uppermost ends of the products are received through the holes of the base and such that the base of the collar positively rests on the upper portions of the products at a predetermined height. The collar also includes upstanding sides projecting from a periphery of the base, the sides having a height from the base of the collar which is greater than a distance of the uppermost ends of the products from the base of the collar. A top is further provided for the case which is supported by the side walls. Finally, a support means is located between the products for maintaining the top of the case separated from the uppermost ends of the products. This support means rests on the base of the collar and has a height from said base which is greater than a distance of the uppermost ends of the products from the base.

Preferably, the support means includes at least two planar members which are interconnected so as to be self-sustaining. More preferably, where the products are arranged in a series of rows, the support means includes at least one U-shaped element having respective legs formed by the two planar members and having a connecting member connecting adjacent ends of the planar members. In this configuration, the planar members have a length substantially equal to a length of the rows of the products and the connecting member has a length substantially equal to a row to row spacing of the products. If desired, the support means can include two of the U-shaped elements; and even a second connecting member which connects adjacent free ends of adjacent U-shaped elements to form a single supporting insert having a square tooth shape. Conveniently, the U-shaped element is formed of a single strip formed into a squared U-shape, and this strip is formed of corrugated cardboard having perforation lines at the intersections of the connecting member with the legs for bending the strip into the squared U-shape.

In a preferred embodiment, the base of the collar extends between an inside periphery of the side walls of the case, and the upstanding sides of the collar extend parallel to an adjacent side wall of the case. This collar is typically made of a die-cut chipboard.

In the preferred embodiment, the case is formed as a rectangular cardboard box. The collar then has a rectangular base which extends between the side walls of the case, and there are four upstanding sides of the collar which extend parallel to an adjacent side wall of the case. In this embodiment, the top, the floor and the side walls of the case are all integrally formed from a single sheet of material, such as corrugated board.

It is an advantage of the present invention that a simple and effective packaging system is provided which protects the uppermost ends of the products from contacting the top of the case during shipping.

It is also an advantage of the present invention that the packaging system is economical and easily assembled.

It is a further advantage of the present invention that the packaging system is easily and quickly disassembled and disposed of by the consumer or seller.

Other features and advantages of the present invention are stated in or apparent from detailed descriptions of presently preferred embodiments of the invention found hereinbelow.

DETAILED DESCRIPTION OF THE PREFERRED EMBODIMENTS

Figure 1:
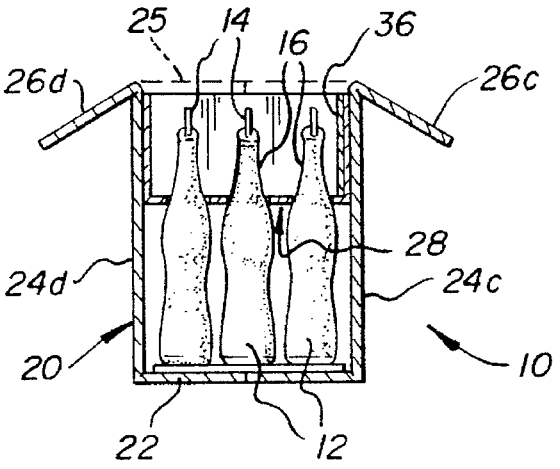
FIG. 1 is a cross-sectional side elevation view of packaging system of the present invention with the top open.
Figure 2:
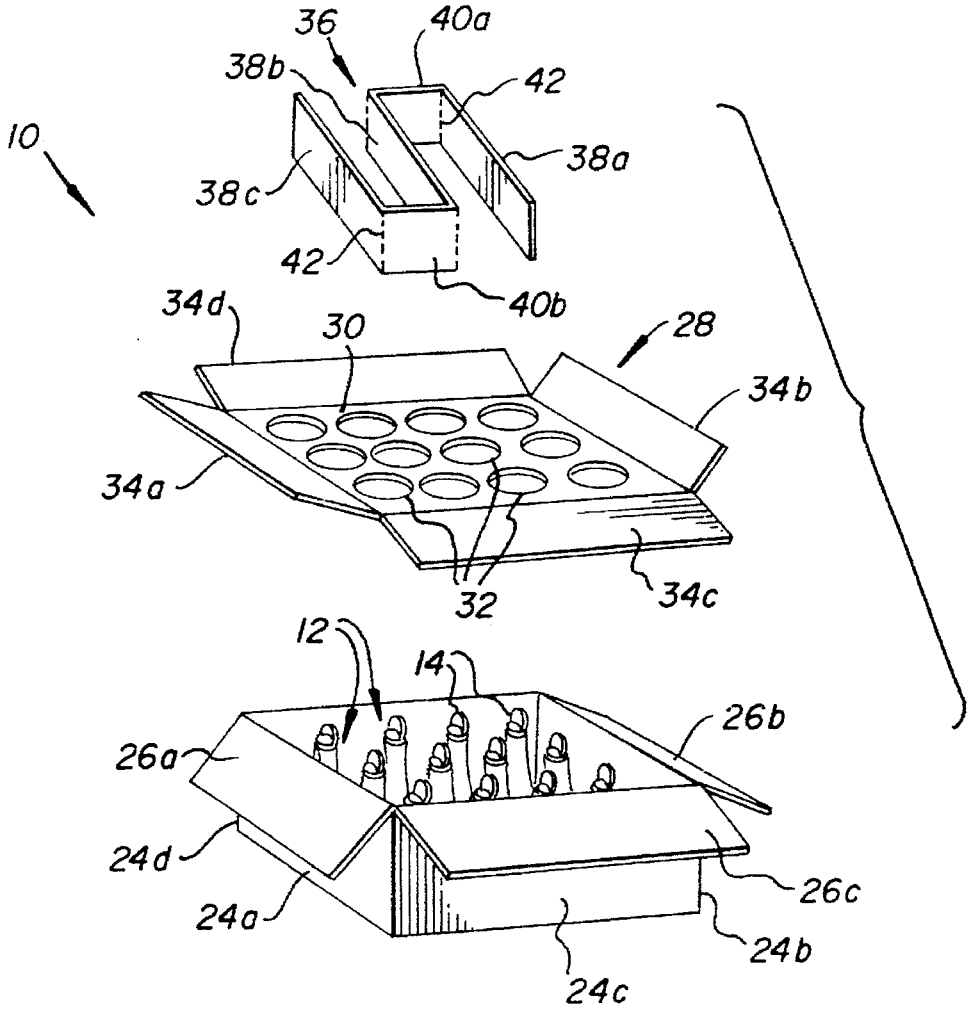
FIG. 2 is an exploded perspective view of the packaging system depicted in FIG. 1.
Figure 3:
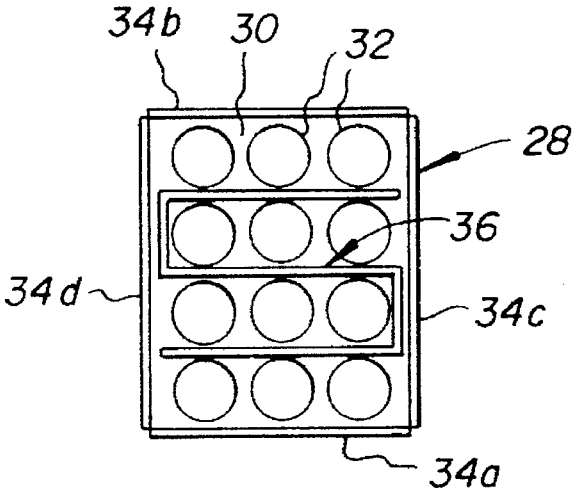
FIG. 3 is a top view of the collar and support member depicted in FIG. 1.

With reference now to the drawings in which like numerals represent like elements throughout the views, a first embodiment of a packaging system 10 according to the present invention is depicted in FIGS. 1 to 3. Packaging system 10 is designed for encasing and protecting a plurality of vertically-standing, elongated products 12 such as one-piece plastic beverage bottles. It will be appreciated that products 12 thus have an uppermost end 14 which is particularly susceptible to damage and subsequent leakage of the liquid contained in product 12 due to any impact thereon. Obviously, during shipping of products 12 many jarrings of the packaging system for products 12 are likely including impacts on the top of the packaging system (such as during stacking) and dropping of the packaging system onto its top. Products 12 typically have a downwardly diverging upper portion 16 beneath uppermost end 14. Upper portion 16 is usually formed with a convex shape typical of bottles and other containers of this type. As will be appreciated by those skilled in the art, products 12 may have other geometrics capable of supporting an apertured collar in the manner described below.

Packaging system 10 includes a preferably rectangular case 20 having a rectangular floor 22 on which products 12 stand. It will be appreciated that products 12 stand in a preset pattern, in this case four rows of three products 12 each (or a regular 3'4 matrix of products 12) for a total of twelve products per case 20. Case 20 also includes four vertical side walls extending upwardly from floor 22, lateral side walls 24*a* and 24*b* and longitudinal side walls 24*c* and 24*d*. Side walls 24*a–d* all include respective flaps 26*a–d* at the upper edges thereof which are folded over to horizontal and glued together to form a top 25 (shown in phantom in FIG. 1) for case 20 which is supported by side walls 24*a–d*. Preferably, floor 22 is similarly formed of folded and glued flaps extending from side walls 24*a–d* in the manner well known in the art with case 20 thus being formed from a single cutout of corrugated cardboard.

Located inside of case 20 is a collar 28 which is designed to maintain products 12 in the preset pattern. Collar 28 includes a rectangular base 30 which extends horizontally between an inside periphery of side walls 24*a–d* of case 20. Only a slight slip fit or clearance distance separates base 30 from side walls 24*a–d*. Base 30 includes a pattern of holes 32 matching the preset pattern of products 12 in case 20. Holes 32 are particularly sized so that uppermost ends 14 of products 12 are received therethrough, whereby base 30 thus engages an identically-sized upper portion 16 of each product 12 and is positively supported by this engagement at a predetermined height on products 12 and above floor 22. It will be appreciated that upper portions 16 of products 12 are not easily broken or deformed so that cumulatively upper portions 16 of products 12 vertically support base 30 with a fairly high strength. Collar 28 also includes four upstanding sides 34*a–d* projecting from the four edges of the periphery of rectangular base 30. As partially shown in FIG. 1, when packaging system 10 is assembled, upstanding sides 34*a–d* extend parallel and immediately adjacent a respective side wall 24*a–d* of case 20. Conveniently, collar 28 is formed of a die-cut chipboard.

It will be appreciated that the height of upstanding sides 34*a–d* from base 30 is greater, by about half an inch in this embodiment, than the height of uppermost ends 14 of products 12 from base 30 when base 30 rests on upper portions 16 of products 12 in case 20. It will also be appreciated that the uppermost edges of upstanding sides 34*a–d* are typically at the same overall height as the upper edges of side walls 24*a–d* and hence are adjacent top 25 of case 20. To accommodate this, it will further be appreciated that side walls 24*a–d* have a height which is greater, by about half an inch in this embodiment, than that of products 12.

Also located inside of case 20 is a support means 36 which rests on base 30 of collar 28. Support means 36 is located between products 12 in case 20, as will be appreciated from FIG. 3 which depicts the location of support means 36 relative to holes 32 of collar 28 through which uppermost ends 14 extend. The purpose of support means 36 is to maintain top 25 separated from uppermost ends 14 of products 12 even when an impact is received to top 25, such as when the packaging system 10 is dropped and top 25 hits the ground. To accomplish this, support means 36 has a height from base 30 to top 25 which is greater than a distance of uppermost ends 14 of products 12 from base 30. Preferably, the height of support means 36 is the same as that of upstanding sides 34*a–d*, so that a clearance space of about half an inch is provided between the uppermost ends 14 of products 12 and top 25.

Preferably, support means 36 includes at least two planar member 38*a* and 38*b* which are interconnected so as to be self-supporting or self-sustaining. Conveniently, this self-sustaining is achieved by making support means 36 as at least one U-shaped element having legs formed by planar members 38*a* and 38*b* a connecting member 40*a* which connects adjacent ends of planar members 38*a–b*. With this configuration, planar members 38*a–b* preferably have a horizontal length substantially equal to a length of the rows of products 12 while connecting member 40 has a horizontal length substantially equal to the row to row spacing of products 12.

According to the depicted preset pattern of products 12, support means 36 includes a second connecting member 40*b* and an additional planar member 38*c* so that support means is a single strip formed into a square tooth shape. With this particularly preferred configuration, each product 12 is horizontally bordered on at least two sides by support means 36 and/or a portion of side walls 24*a–d* for added lateral protection. Such a single strip is conveniently formed of corrugated board with perforation lines 42 at the intersections of connecting members 40 with planar members 38 for ease of bending the single strip into the square tooth shape of support means 36. In addition, the thickness of planar members 38*a–b* and connecting member 40 is equal to or slightly less than the spacing between each row of holes of about one eighth inch so that these members are positively positioned by the immediately adjacent upper portions 16 of products 12.

The assembly of packaging system 10 is easily understood with reference to FIG. 2. As shown in that figure, case 20 is first formed into an open topped rectangular box in which products 12 are deposited in the predetermined preset pattern, in this embodiment a 3'4 matrix. Next, base 30 of collar 28 is fitted over uppermost ends 14 of products as uppermost ends 14 are received through holes 32. Base 30 is moved down into package 20 until base 30 contacts and is strongly supported vertically by the cumulative effect of upper portions 16 of all of products 12. At this position, it will be appreciated that upstanding sides 34*a–d* are immediately adjacent and positioned parallel to a respective side wall 24*a–d* as shown in FIG. 1.

Support means 36 is then lowered into place between upper portions 16 of products until support means 36 rests on base 30 of collar 28. At this time, it will be appreciated that side walls 24*a–d*, upstanding sides 34*a–d*, planar members 38*a–c* and connecting members 40*a–b* all have upper edges at the same height where top 25 is to be formed, and these upper edges and top 25 are all about half an inch above uppermost ends 14 of products 12. Thus, when top 25 is formed above base 30, a rigid container for uppermost ends 14 is formed by base 30, side walls 24*a–d*, upstanding sides 34*a–d*, planar members 38*a–c* and connecting members 40*a–b*. These elements of the container mutually reinforce one another and effectively resist impacts on top 25 which might otherwise damage uppermost ends 14 of products 12. In addition, these elements (especially base 30 of collar 28) also maintain products 12 in the preset pattern, particularly where the bottoms of the products are spaced closely adjacent one another and/or side walls 24*a–d*.

Figure 4:
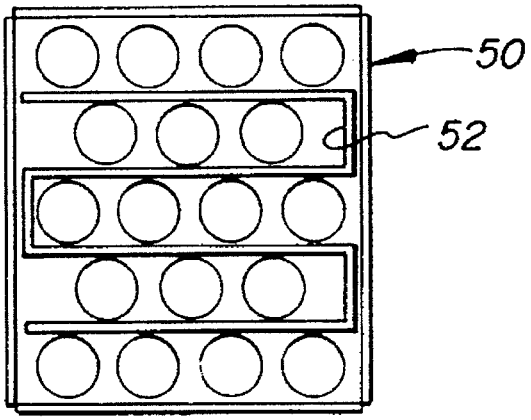
FIG. 4 is a top view of an alternative embodiment of a collar and support member for a packaging system of the present invention.
Figure 5:
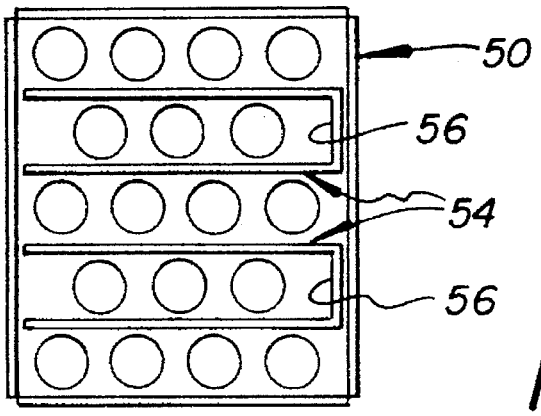
FIG. 5 is a top view of a further alternative embodiment of a collar and support member for a packaging system of the present invention.

Depicted in FIGS. 4 and 5 is a another embodiment of a collar 50 for use with a case containing eighteen products 12 arranged in a series of alternating rows of four and three products 12. An alternative embodiment of a support means 52 for collar 50 is then depicted in FIG. 4. Support means 52 is similar to support means 36 and is formed of a single strip fashioned into a square tooth shape sufficient to present one side thereof to each product 12. In FIG. 5, a further support means 54 for use with collar 50 is shown which is formed of two (separate) U-shaped elements 56.

In each product configuration, a planar element of the support means should extend between each adjacent row (or column) of products. In this manner, weight or shocks will be more broadly dispersed and the likelihood that the base of the collar will rupture is minimized.

While support means 36, 52 and 54 have been depicted in the figures as having a square tooth shape, it will be appreciated that other configurations are possible which will provide the same vertical support. For example, with the 3'4 matrix of products 12 depicted, a single U-shaped support element having planar members parallel to longitudinal side walls 24*c* and 24*d* and with the length of four products 12 could be used. In addition, an H-shaped element or other elements offering suitable vertical support could be used including elements with rounded corners rather than right angle corners. However, the depicted-embodiments are preferred as they maximize protection while minimizing the amount of material and time needed to form the support means, to position the support means, and ultimately to remove the support means.

Thus, while the present invention has been described with respect to exemplary embodiments thereof, it will be understood by those of ordinary skill in the art that variations and modifications can be effected within the scope and spirit of the invention.

What is claimed is:

1. A packaging system for a plurality of upright, one-piece, plastic beverage bottles having twist-away ends where each bottle has an uppermost end and a downwardly-diverging upper portion beneath the uppermost end, said packaging system comprising:

a rectangular package having a rectangular floor on which the bottles stand in a preset pattern of a series of rows and four side walls extending upwardly from said floor;

a collar, made of die-cut chipboard, which maintains the bottles in the preset pattern in said package, said collar including (a) a rectangular base which extends between said side walls of said package and which is provided with a preset pattern of holes matching the preset pattern of the bottles such that the uppermost ends of the bottles are received through said holes of said base and such that said base positively rests on the upper portions of the bottles at a predetermined height of the bottles, and (b) four, upstanding sides projecting from a periphery of said rectangular base parallel and immediately adjacent a respective said side wall of said package, said sides having a height from said base which is greater than a distance of the uppermost ends of the bottles from said base;

a top for said package which is supported by said side walls; and at least one support element, formed of corrugated cardboard, said support element having at least two respective legs, each leg formed by a rectangular planar member and having a rectangular connecting member connecting adjacent ends of said planar members, said planar members having a length substantially equal to a length of the rows of the bottles and wherein a planar member extends between each adjacent row of bottles, said connecting member having a length substantially equal to a row to row spacing of the bottles, and said planar members and said connecting member having a height from said base which is greater than a distance of the uppermost ends of the bottles from said base for maintaining said top separated from the uppermost ends of the bottles as said support element rests on said base and said base is supported by the upper portions of the bottles.

2. A packaging system as claimed in claim 1 including two support elements.

3. A packaging system as claimed in claim 1 wherein the rectangular planar members of the support element have a thickness which is about equal to the spacing between each row of holes in the rectangular base such that each member is positively positioned by the immediate upper portions of the bottles.

* * * * *